US012631180B2

(12) United States Patent
Hosaka et al.

(10) Patent No.: US 12,631,180 B2
(45) Date of Patent: May 19, 2026

(54) LIQUID FEEDING SYSTEM OF COMPRESSOR

(71) Applicant: Hitachi, Ltd., Tokyo (JP)

(72) Inventors: Tomoyuki Hosaka, Tokyo (JP); Eiji Ishii, Tokyo (JP); Kazuki Yoshimura, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 5 days.

(21) Appl. No.: 18/710,763

(22) PCT Filed: Oct. 11, 2022

(86) PCT No.: PCT/JP2022/037912
§ 371 (c)(1),
(2) Date: May 16, 2024

(87) PCT Pub. No.: WO2023/095469
PCT Pub. Date: Jun. 1, 2023

(65) Prior Publication Data

US 2025/0043782 A1 Feb. 6, 2025

(30) Foreign Application Priority Data

Nov. 26, 2021 (JP) ..... 2021-192529

(51) Int. Cl.
*F04C 18/16* (2006.01)
*F04C 29/04* (2006.01)

(52) U.S. Cl.
CPC ..... *F04C 18/16* (2013.01); *F04C 29/042* (2013.01)

(58) Field of Classification Search
CPC ..... F04C 18/16; F04C 29/042
See application file for complete search history.

(56) References Cited

U.S. PATENT DOCUMENTS 4,049,410 A * 9/1977 Miller ..... F04C 29/042 62/505
5,174,741 A * 12/1992 Tohgo ..... F04C 29/042 418/87

(Continued)

FOREIGN PATENT DOCUMENTS

JP 2010-138721 A 6/2010
WO WO-2019/239703 A1 12/2019

OTHER PUBLICATIONS

International Search Report with English Translation and Written Opinion of International Patent Application No. PCT/JP2022/037912 dated Nov. 22, 2022 (9 pages).

*Primary Examiner* — Mary A Davis
(74) *Attorney, Agent, or Firm* — Foley & Lardner LLP

(57) ABSTRACT

The objective of the present invention is to provide a liquid feed system for a compressor, capable of easily forming fine droplets of a liquid to be injected into the compressor. A liquid feed system 100 of a compressor 1 for compressing a gas injects a liquid 50 into the inside of the compressor 1. The liquid feed system 100 adjusts the temperature of the liquid 50 to be injected into the compressor 1 to a temperature at least equal to a saturation temperature Tf corresponding to a pressure inside the compressor 1, and adjusts the temperature to a temperature lower than a saturation temperature Ti corresponding to a pressure of the liquid 50 at the time of injection into the compressor 1, and then injects the liquid 50 into the compressor 1.

7 Claims, 9 Drawing Sheets

(56) References Cited

U.S. PATENT DOCUMENTS

| | | | | |
|---|---|---|---|---|
| 7,413,419 | B2 * | 8/2008 | De Smedt | F04C 18/16<br>417/410.3 |
| 2019/0093659 | A1 | 3/2019 | Crum et al. | |

* cited by examiner

LIQUID FEEDING SYSTEM OF COMPRESSOR

TECHNICAL FIELD

The present invention relates to a liquid feeding system of a compressor.

BACKGROUND ART

As a compressor that compresses a gas such as water vapor or air, there is a screw compressor. The screw compressor is a device that generates a compressed gas by meshing a pair of screw rotors of a male rotor and a female rotor formed in a screw shape. In order to improve gas compression efficiency, the screw compressor is provided with a liquid feeding system that injects a liquid into a compression chamber in a casing that accommodates the male rotor and the female rotor.

The injected liquid function to cool the compressed gas by heat exchange. Further, the injected liquid seals a gap between the male rotor and the female rotor and a gap between the male rotor or the female rotor, and the casing, and functions to reduce gas leakage from these gaps. When the liquid to be injected evaporates in the compression chamber as in the case of water, the liquid can cool the compressed gas by latent heat of evaporation in addition to heat exchange. In this case, for efficient heat exchange and evaporation, it is necessary to inject the liquid so that the liquid becomes fine droplets in the compression chamber.

As conventional techniques of the liquid feeding system, for example, there are PTL 1 and PTL 2. PTL 1 discloses a liquid feeding mechanism that injects a liquid into a compressor while generating a swirling flow of the liquid inside the liquid feeding mechanism. The liquid feeding mechanism disclosed in PTL 1 makes a liquid into fine droplets by the action of the centrifugal force generated by the swirling flow.

PTL 2 discloses a liquid feeding mechanism in which two injection nozzles are disposed to face each other and liquids injected from the two injection nozzles are caused to collide. In the liquid feeding mechanism disclosed in PTL 2, the colliding liquid forms a liquid film, and the tip of the liquid film is broken to form fine droplets, thereby making the liquid into fine droplets.

CITATION LIST

Patent Literature

PTL 1: US 2019/093659 A
PTL 2: WO 2019/239703 A

SUMMARY OF INVENTION

Technical Problem

However, the liquid feeding mechanisms disclosed in PTL 1 and PTL 2 both have a complicated structure, and it is difficult to easily realize fine droplets of a liquid in a narrow space in a compressor, such as a compression chamber.

The present invention has been made in view of the above circumstances, and an object thereof is to provide a liquid feeding system of a compressor, which is capable of easily realizing fine droplets of a liquid injected into a compressor.

Solution to Problem

In order to solve the above problems, according to the present invention, there is provided a liquid feeding system of a compressor that injects a liquid into a compressor that compresses a gas, in which a temperature of the liquid injected into the compressor is adjusted to a temperature equal to or higher than a saturation temperature corresponding to a pressure inside the compressor, and the liquid is injected into the compressor.

Advantageous Effects of Invention

According to the present invention, it is possible to provide a liquid feeding system of a compressor, which is capable of easily realizing fine droplets of a liquid injected into a compressor.

Objects, configurations, and advantageous effects other than those described above will be clarified by the descriptions of the following embodiments.

DESCRIPTION OF EMBODIMENTS

Hereinafter, embodiments of the present invention will be described with reference to the drawings. Note that components denoted by the same reference signs in the respective embodiments have similar functions in the respective embodiments unless otherwise specified, and the description thereof will be omitted.

Embodiment 1

A liquid feeding system 100 according to Embodiment 1 will be described with reference to FIGS. 1 to 7.

Figure 1:
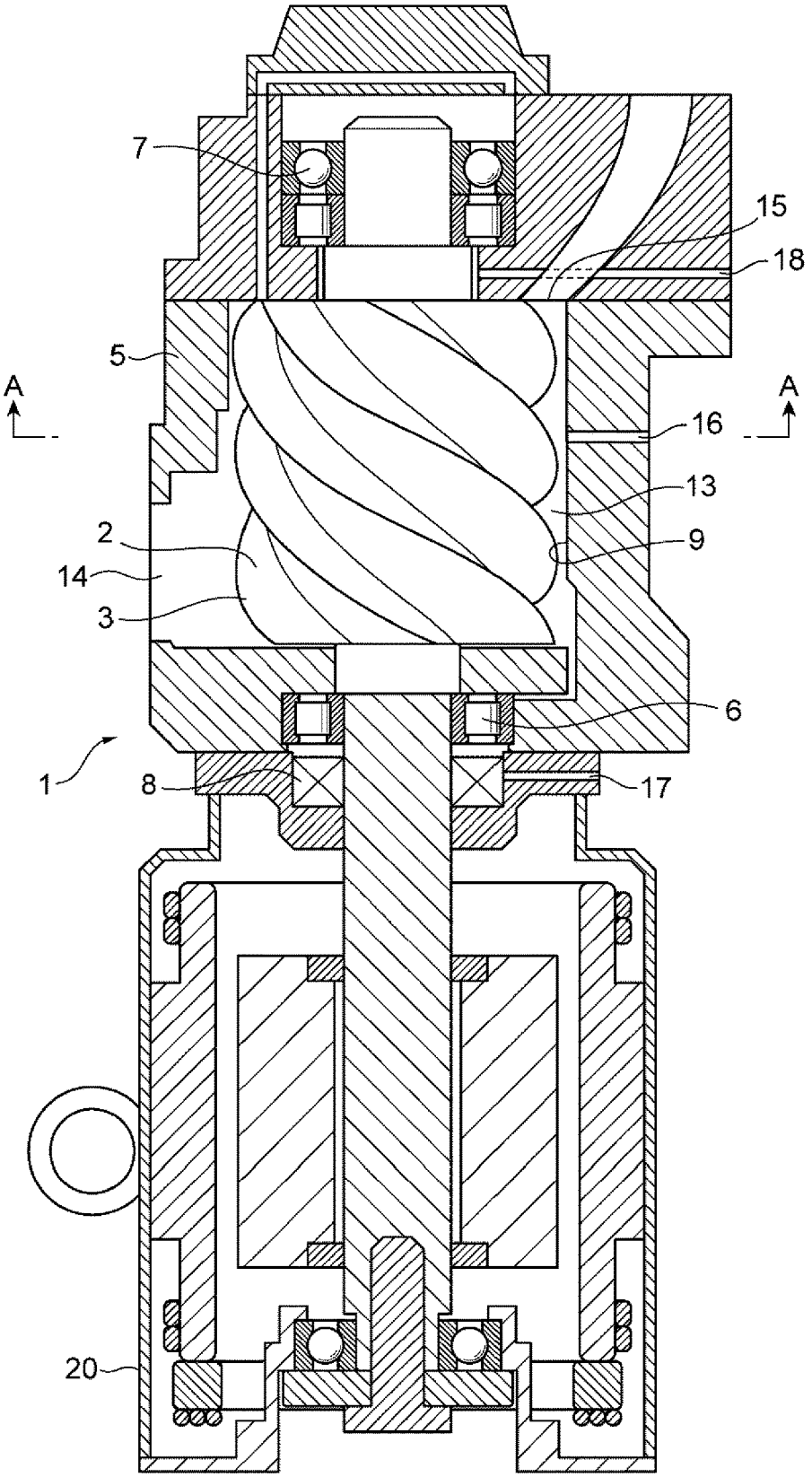
FIG. 1 is a view illustrating a configuration of a compressor.

The liquid feeding system 100 is a system that injects a liquid 50 such as water into a compressor 1 (for example, a compression chamber 13) that compresses air or a gas such as water vapor, and supplies the liquid 50 into the compressor 1. In the present embodiment, a screw compressor as illustrated in FIG. 1 will be described as an example of the compressor 1, but the compressor 1 may be another type of compressor. In the present embodiment, water vapor will be described as an example of the gas compressed by the compressor 1, but the gas compressed by the compressor 1 may be a gas other than water vapor. In the present embodiment, water will be described as an example of the liquid 50 injected into the compressor 1, but the liquid 50 injected into the compressor 1 may be a liquid other than water. That is, in the present embodiment, the liquid 50 injected into the compressor 1 is a substance of the same type (component) as the gas compressed by the compressor 1.

Figure 2:
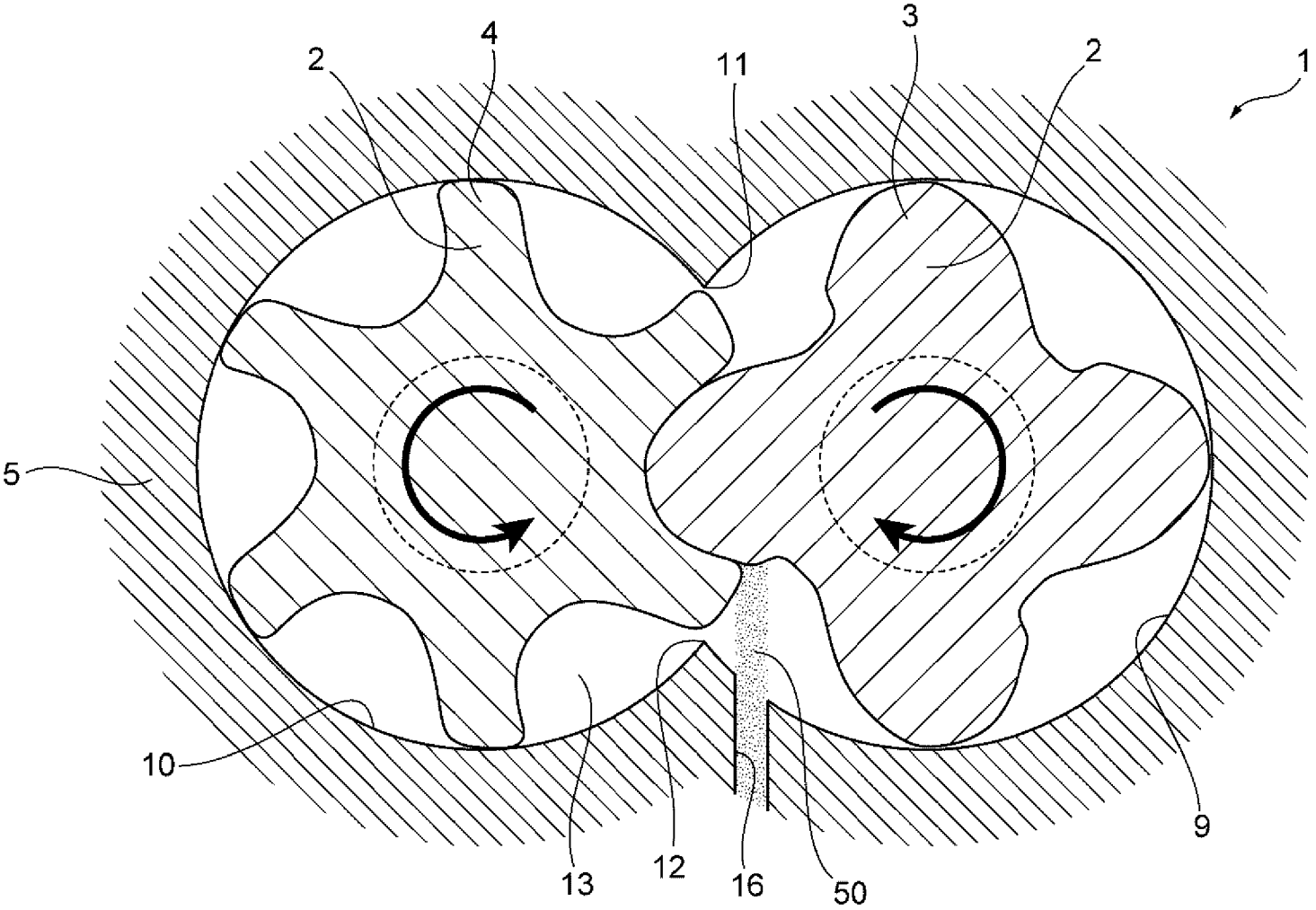
FIG. 2 is a cross-sectional view of the compressor taken along line A-A illustrated in FIG. 1.

FIG. 1 is a view illustrating a configuration of the compressor 1. FIG. 2 is a cross-sectional view of the compressor 1 taken along line A-A illustrated in FIG. 1.

The compressor 1 includes a screw rotor 2 and a casing 5 that accommodates the screw rotor 2. The screw rotor 2 includes a male rotor 3 and a female rotor 4 that each have twisted teeth (lobes) and rotate in mesh with one another. In the present embodiment, the screw rotor 2 is a general term for the male rotor 3 and the female rotor 4. A suction-side end portion of the male rotor 3 is connected to a motor 20 as a rotation drive source via a rotor shaft. The male rotor 3 that is rotationally driven by the motor 20 rotationally drives the female rotor 4.

The compressor 1 includes a suction-side bearing 6 and a discharge-side bearing 7 for rotatably supporting the male rotor 3 and the female rotor 4, respectively, and a shaft seal component 8 such as an oil seal or a mechanical seal. In the present embodiment, the "suction side" refers to a gas suction side in an axial direction of the screw rotor 2, and the "discharge side" refers to a gas discharge side in the axial direction of the screw rotor 2.

A cylindrical male-side bore 9 that covers the male rotor 3 and a cylindrical female-side bore 10 that covers the female rotor 4 are formed on an inner surface of the casing 5. Gaps of several 10 μm to several 100 μm are formed between the male-side bore 9 and the male rotor 3 and between the female-side bore 10 and the female rotor 4, respectively. An intersection line between the male-side bore 9 and the female-side bore 10 includes two lines of an intersection line on a low-pressure side and an intersection line on a high-pressure side. The intersection line on the low-pressure side is defined as a suction-side cusp 11. The intersection line on the high-pressure side is defined as a compression-side cusp 12.

A space defined by the tooth grooves of the male rotor 3 and the female rotor 4 and the male-side bore 9 and the female-side bore 10 surrounding the tooth grooves is a compression chamber 13. The compression chamber 13 repeats expansion and contraction by the rotation of the male rotor 3 and the female rotor 4. As a result, a gas as a compression target is sucked into the compression chamber 13 from a suction port 14 communicating with the compression chamber 13, compressed to a predetermined pressure in the compression chamber 13, and then discharged to the outside of the compressor 1 from a discharge port 15 communicating with the compression chamber 13.

The compressor 1 further includes a liquid feeding hole 16 for supplying the liquid 50 into the compression chamber 13, a liquid feeding hole 17 for supplying the liquid 50 to the suction-side bearing 6 and the shaft seal component 8, and a liquid feeding hole 18 for supplying the liquid 50 to the discharge-side bearing 7.

Figure 3:
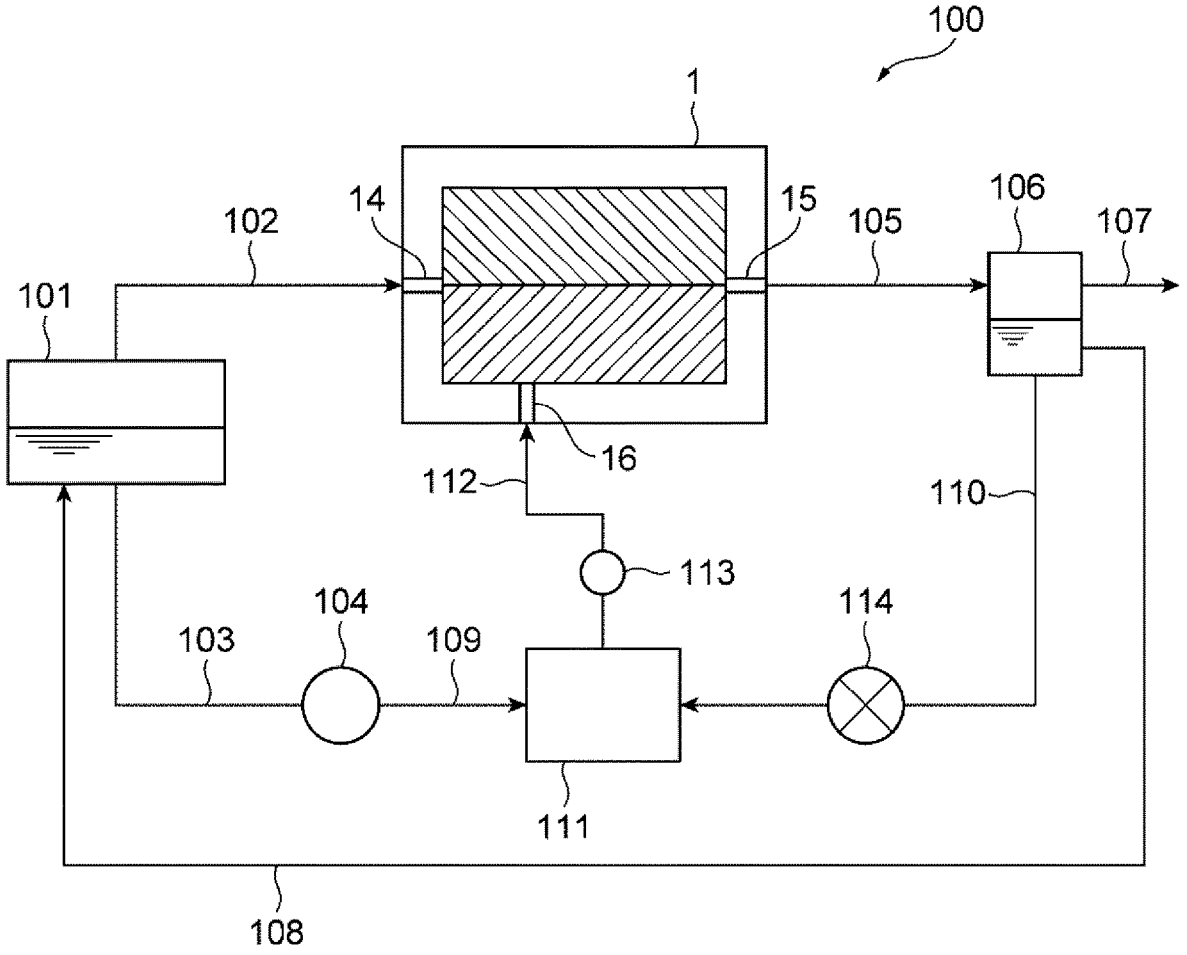
FIG. 3 is a diagram illustrating a configuration of a liquid feeding system in Embodiment 1.

FIG. 3 is a diagram illustrating a configuration of the liquid feeding system 100 in Embodiment 1. In FIG. 3, illustration of a flow path for supplying the liquid 50 from the liquid feeding hole 17 or the liquid feeding hole 18 to the suction-side bearing 6, the discharge-side bearing 7, or the shaft seal component 8 is omitted.

The liquid feeding system 100 injects a liquid 50 (water) into the compression chamber 13 of the compressor 1 that compresses a gas (water vapor). The liquid 50 injected into the compression chamber 13 cools the compressed gas by heat exchange with the compressed gas present in the compression chamber 13. Further, the liquid 50 injected into the compression chamber 13 is evaporated in the compression chamber 13, and cools the compressed gas by latent heat of evaporation. Further, the liquid 50 injected into the compression chamber 13 seals a gap between the male rotor 3 and the female rotor 4 and a gap between the male rotor 3 or the female rotor 4, and the casing 5, and reduces gas leakage from these gaps.

The liquid feeding system 100 includes a vapor generator 101, a gas-side flow path 102, a liquid-side flow path 103, a pump 104, a discharge-side flow path 105, a gas-liquid separator 106, a transport flow path 107, a relief flow path 108, a first flow path 109, a second flow path 110, a mixer 111, a third flow path 112, a temperature measuring device 113, and a flow rate adjusting valve 114. Note that the liquid feeding system 100 may further include a control device (not illustrated) that comprehensively controls the operation of these components.

The vapor generator 101 is a device that generates a gas (water vapor) as a compression target. The gas-side flow path 102 is a pipe that causes a gas chamber of the vapor generator 101 to communicate with the suction port 14 of the compressor 1. The gas-side flow path 102 supplies the gas generated by the vapor generator 101 to the compressor 1. The gas supplied to the compressor 1 is compressed in the compression chamber 13 by the rotation of the screw rotor 2, and is discharged as the compressed gas from the discharge port 15 of the compressor 1.

The liquid-side flow path 103 is a pipe that causes a liquid chamber of the vapor generator 101 to communicate with a suction port of the pump 104. The liquid-side flow path 103 supplies, to the pump 104, the liquid 50 stored in the liquid chamber of the vapor generator 101 as a gas generation source in the vapor generator 101. The pump 104 pressurizes the liquid 50 supplied from the liquid chamber of the vapor generator 101. That is, the pump 104 pressurizes the liquid 50 before being injected into the compressor 1.

The discharge-side flow path 105 is a pipe that causes the discharge port 15 of the compressor 1 to communicate with the gas-liquid separator 106. The discharge-side flow path 105 supplies the compressed gas discharged from the compressor 1 to the gas-liquid separator 106. Note that a part of the liquid 50 injected into the compression chamber 13 is not completely evaporated and remains as a liquid, and is discharged from the compression chamber 13 to the discharge-side flow path 105 via the discharge port 15. The discharge-side flow path 105 supplies the liquid 50 discharged from the compressor 1 to the gas-liquid separator 106.

The gas-liquid separator 106 is a device that separates the compressed gas and the liquid 50 supplied from the discharge-side flow path 105. The transport flow path 107 is a pipe that causes a gas chamber of the gas-liquid separator 106 to communicate with a transport target of the compressed gas. The transport flow path 107 transports the compressed gas separated by the gas-liquid separator 106 to the transport target. The relief flow path 108 is a pipe that causes the liquid chamber of the gas-liquid separator 106 to communicate with the liquid chamber of the vapor generator 101. The relief flow path 108 releases predetermined amount or more of the liquid 50 stored in the liquid chamber of the gas-liquid separator 106 to the liquid chamber of the vapor generator 101.

The first flow path 109 is a pipe that causes a discharge port of the pump 104 to communicate with the mixer 111. The first flow path 109 supplies the liquid 50 pressurized by the pump 104 to the mixer 111. That is, the first flow path 109 is a flow path through which the liquid 50 that is the liquid 50 before being injected into the compressor 1 and is pressurized by the pump 104 flows.

The second flow path 110 is a pipe that causes the liquid chamber of the gas-liquid separator 106 to communicate with the mixer 111. The second flow path 110 supplies the liquid 50 separated by the gas-liquid separator 106 to the mixer 111. That is, the second flow path 110 is a flow path through which the liquid 50 discharged from the compressor 1 after being injected into the compressor 1 flows. The liquid 50 discharged from the compressor 1 after being injected into the compressor 1 is the liquid 50 after heat exchange with the compressed gas. Thus, the liquid 50 flowing through the second flow path 110 has a temperature higher than the temperature of the liquid 50 flowing through the first flow path 109.

The mixer 111 is a device that mixes the liquid 50 flowing through the first flow path 109 and the liquid 50 flowing through the second flow path 110. As described above, the liquid 50 flowing through the second flow path 110 has a temperature higher than the temperature of the liquid 50 flowing through the first flow path 109. Thus, the temperature of the liquid 50 mixed in the mixer 111 is an intermediate temperature between the temperature of the liquid 50 flowing through the first flow path 109 and the temperature of the liquid 50 flowing through the second flow path 110.

The third flow path 112 is a pipe that causes the mixer 111 to communicate with the liquid feeding hole 16 of the compressor 1. The third flow path 112 supplies the liquid 50 mixed by the mixer 111 to the liquid feeding hole 16 of the compressor 1. Since the liquid 50 mixed by the mixer 111 is the liquid 50 pressurized by the pump 104, the liquid 50 is injected when the liquid passes through the liquid feeding hole 16 from the third flow path 112 and then flows into the compression chamber 13. That is, the third flow path 112 injects the liquid 50 mixed by the mixer 111 into the compressor 1.

The temperature measuring device 113 is a device that measures the temperature of the liquid 50 flowing through the third flow path 112. That is, the temperature measuring device 113 measures the temperature of the liquid 50 injected into the compressor 1. The flow rate adjusting valve 114 is a valve that adjusts the flow rate of the liquid 50 flowing through the first flow path 109 or the second flow path 110. In the present embodiment, the flow rate adjusting valve 114 is provided at the second flow path 110, and adjusts the flow rate of the liquid 50 flowing through the second flow path 110.

When the flow rate adjusting valve 114 increases the flow rate of the liquid 50 flowing through the second flow path 110, the flow rate of the high-temperature liquid 50 increases, so that the temperature of the liquid 50 mixed in the mixer 111 increases. As a result, the temperature of the liquid 50 flowing through the third flow path 112, the temperature measured by the temperature measuring device 113, increases. When the flow rate adjusting valve 114 decreases the flow rate of the liquid 50 flowing through the second flow path 110, the flow rate of the high-temperature liquid 50 decreases, so that the temperature of the liquid 50 mixed in the mixer 111 is lowered. As a result, the temperature of the liquid 50 flowing through the third flow path 112, the temperature measured by the temperature measuring device 113, is lowered. The same applies to a case where the flow rate adjusting valve 114 adjusts the flow rate of the liquid 50 flowing through the first flow path 109.

The flow rate adjusting valve 114 adjusts the flow rate of the liquid 50 flowing through the first flow path 109 or the second flow path 110, so that the liquid feeding system 100 can adjust the temperature of the liquid 50 measured by the temperature measuring device 113, that is, the temperature of the liquid 50 injected into the compressor 1. The temperature of the liquid 50 injected into the compressor 1 has an influence on an injection form of the liquid 50.

Figure 4:
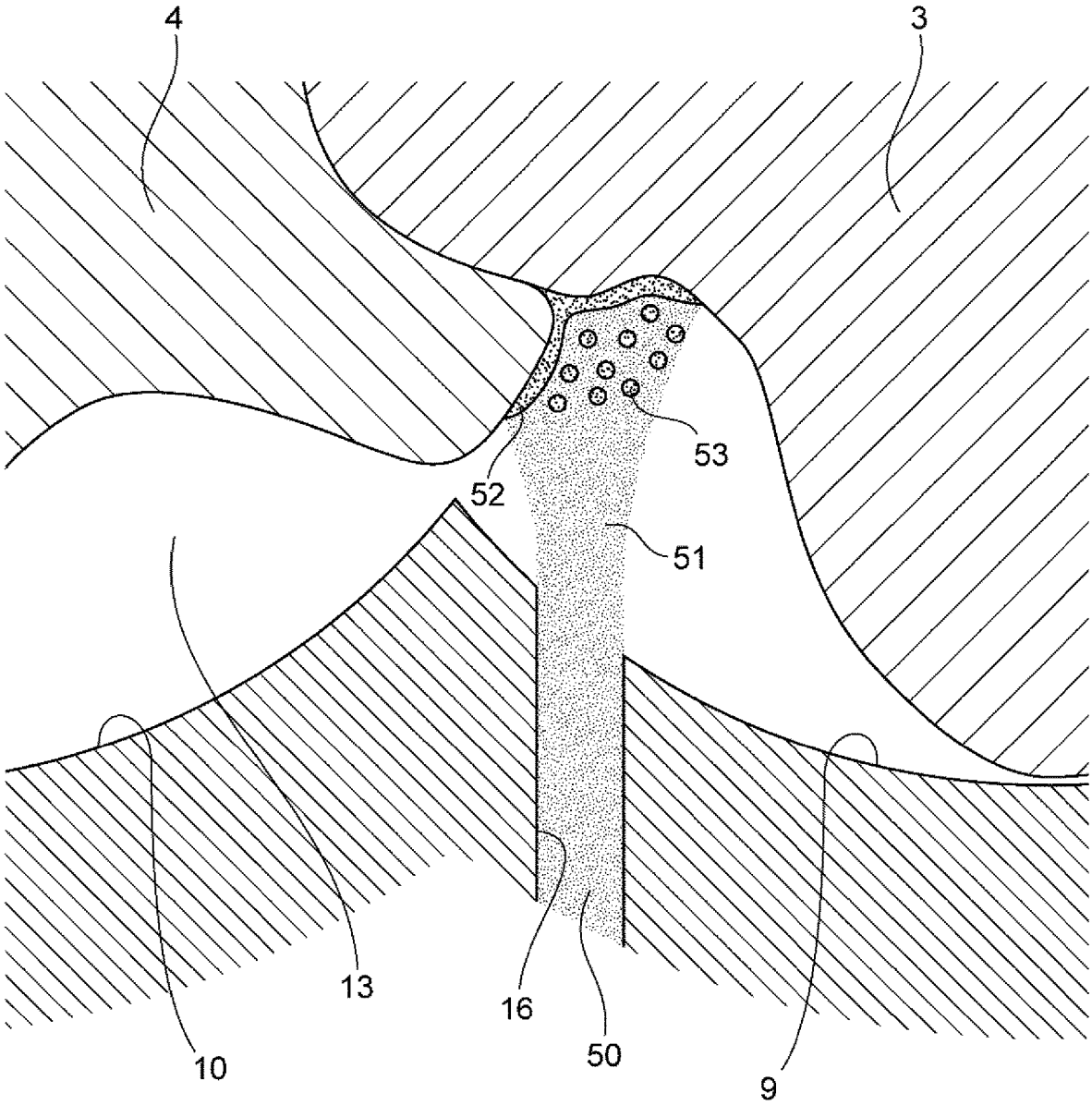
FIG. 4 is a view for describing an injection form of a liquid when a saturated vapor pressure corresponding to a temperature of the liquid injected into the compressor is lower than a pressure of a compression chamber.
Figure 5:
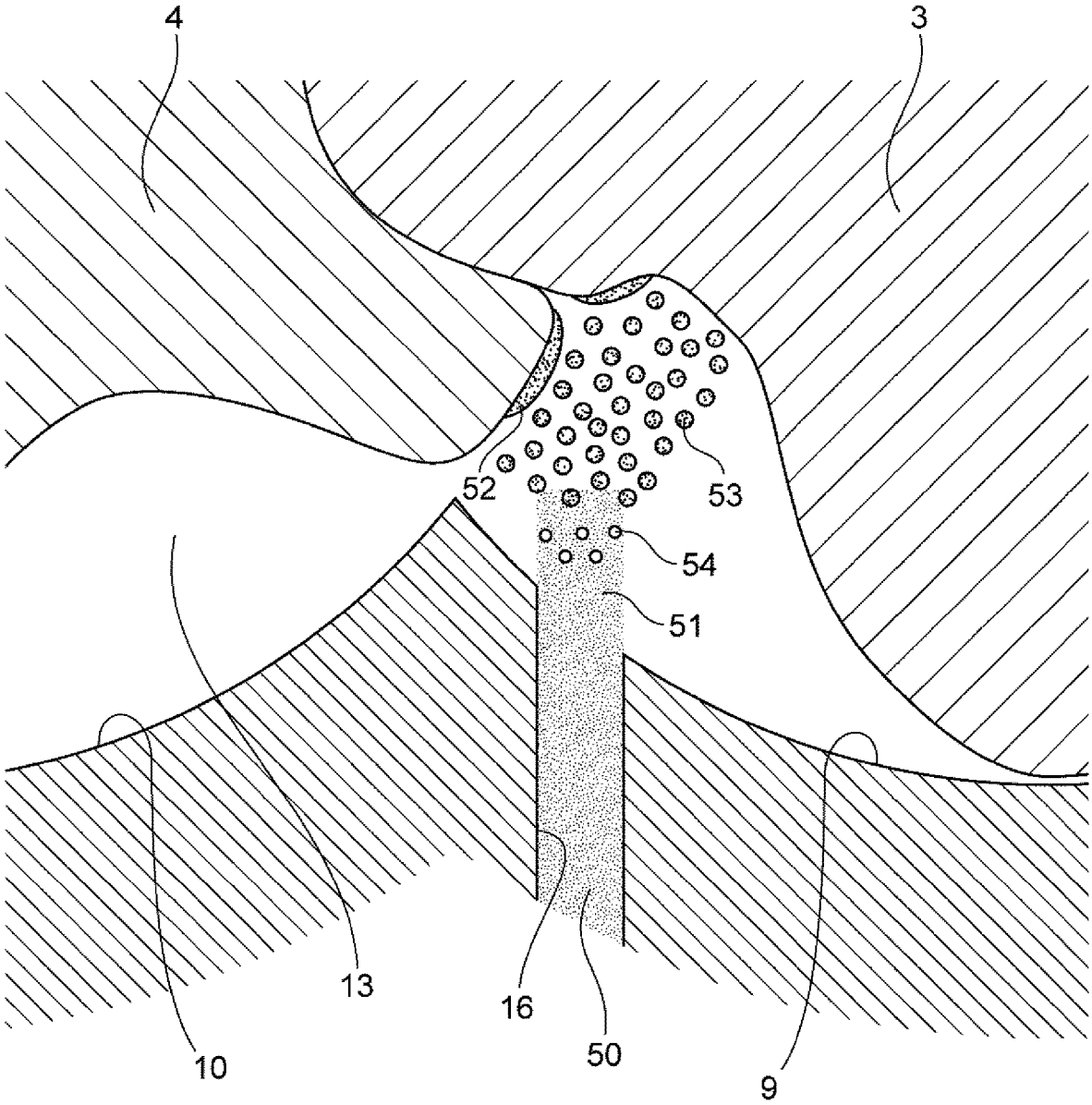
FIG. 5 is a view for describing an injection form of a liquid when the saturated vapor pressure corresponding to the temperature of the liquid injected into the compressor is higher than a pressure of the compression chamber.

FIG. 4 is a view for describing an injection form of the liquid 50 when a saturated vapor pressure corresponding to the temperature of the liquid 50 injected into the compressor 1 is lower than the pressure of the compression chamber 13. FIG. 5 is a view for describing an injection form of the liquid 50 when the saturated vapor pressure corresponding to the temperature of the liquid 50 injected into the compressor 1 is higher than the pressure of the compression chamber 13. FIGS. 4 and 5 are enlarged views of the vicinity of the liquid feeding hole 16 in FIG. 2.

A case where the saturated vapor pressure corresponding to the temperature of the liquid 50 injected into the compressor 1 is lower than the pressure of the compression chamber 13 is a case where the liquid 50 does not boil in the compression chamber 13. In this case, as illustrated in FIG. 4, the liquid 50 flies in the compression chamber 13 in the form of a liquid column 51 and collides with the wall surfaces of the male rotor 3 and the female rotor 4. The liquid column 51 that has collided forms a liquid film 52 on the wall surface. A part of the liquid column 51 forms the droplets 53 and scatters, and flies in the compression chamber 13.

On the other hand, a case where the saturated vapor pressure corresponding to the temperature of liquid 50 injected into compressor 1 is higher than the pressure of compression chamber 13 is a case where the liquid 50 boils in compression chamber 13. In this case, as illustrated in FIG. 5, the liquid 50 flies in the compression chamber 13 in the form of a liquid column 51, but boils to generate bubbles 54 inside the liquid column 51. The volume of the liquid column 51 expands due to the generation of the bubbles 54, whereby the liquid column 51 splits earlier than in the case illustrated in FIG. 4 to form droplets 53. Such a phenomenon is referred to as a flash boiling phenomenon. Due to this phenomenon, in the case illustrated in FIG. 5, the length of the liquid column 51 in an injection direction becomes shorter than that in the case illustrated in FIG. 4, and the amount of the liquid column 51 colliding with the wall surfaces of the male rotor 3 and the female rotor 4 decreases. Thus, the amount of the liquid film 52 decreases and the amount of the droplets 53 increases. In addition, since, due to this phenomenon, the boiling energy contributes to finer particle sizes of the droplets 53, in the case illustrated in FIG. 5, the particle size of the droplets 53 are finer than that in the case illustrated in FIG. 4. When the amount of the droplets 53 increases and the particle size of the droplets 53 becomes finer, the phase change of the liquid 50 in the compression chamber 13 is further accelerated. Thus, the liquid 50 may be evaporated in a shorter time (evaporation rate is improved). For this reason, the temperature of the liquid 50 injected into the compressor 1 is desirably a temperature at which a flash boiling phenomenon can be caused in the compression chamber 13.

Figure 6:
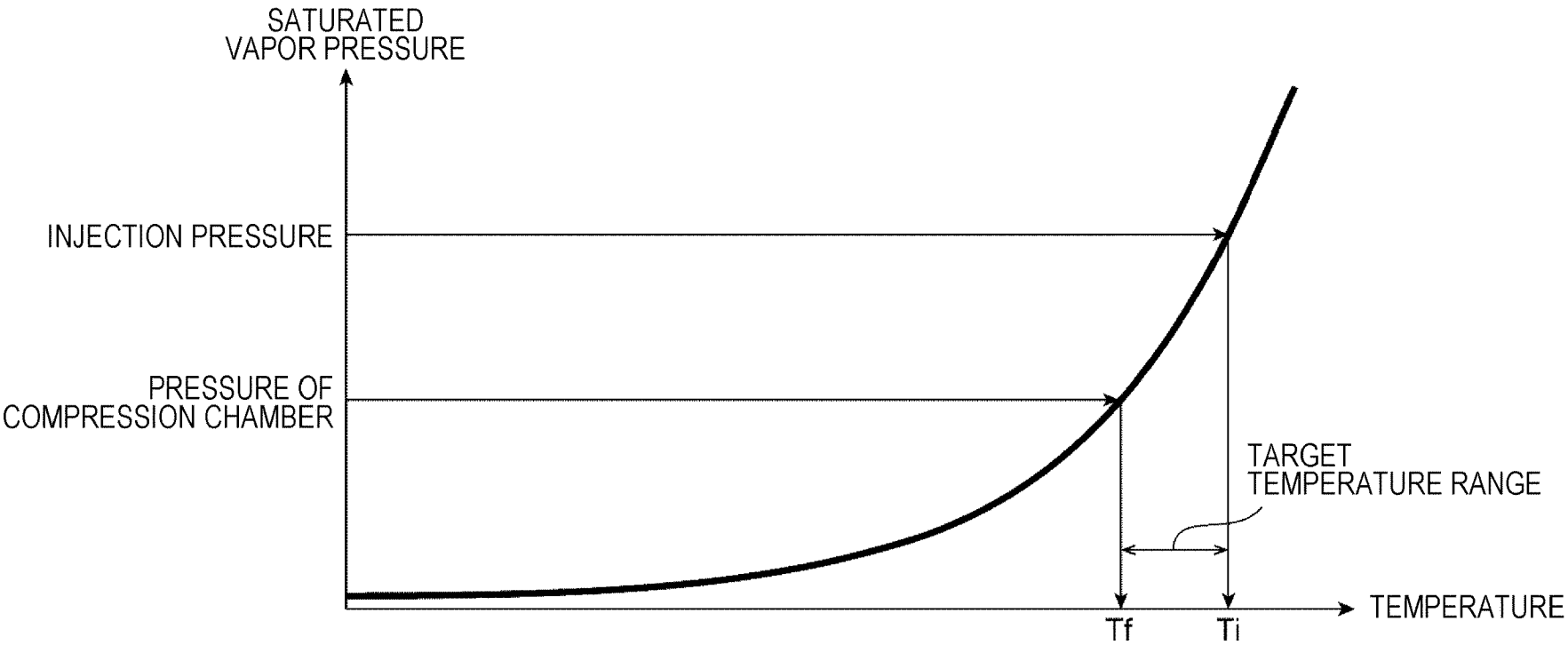
FIG. 6 is a view illustrating a saturated vapor pressure curve of the liquid injected into the compressor.

FIG. 6 is a view illustrating a saturated vapor pressure curve of the liquid 50 injected into the compressor 1.

In order to cause the flash boiling phenomenon in the compression chamber 13, the saturated vapor pressure of the injected liquid 50 needs to be equal to or higher than the pressure of the compression chamber 13. That is, the temperature of the injected liquid 50 needs to be equal to or higher than the saturation temperature Tf corresponding to the pressure of the compression chamber 13.

On the other hand, when the temperature of the injected liquid 50 is too high, boiling starts before the liquid 50 reaches the liquid feeding hole 16, and the third flow path 112 is filled with the vapor of the liquid 50. This causes a problem that it is not possible to inject a sufficient amount of liquid 50 into the compression chamber 13. In order not to cause this problem, the saturated vapor pressure of the injected liquid 50 needs to be lower than the pressure (also referred to as "injection pressure of the liquid 50" below) of the liquid 50 at the time of being injected into the compressor 1. That is, the temperature of the injected liquid 50 needs to be lower than the saturation temperature Ti corresponding to the injection pressure.

Thus, in order to appropriately cause the flash boiling phenomenon in the compression chamber 13, the temperature of the injected liquid 50 needs to be equal to or higher than the saturation temperature Tf corresponding to the pressure of the compression chamber 13 and be lower than the saturation temperature Ti corresponding to the injection pressure. Therefore, the liquid feeding system 100 sets a target temperature range of the temperature T of the injected liquid 50 to a range of Tf≤T<Ti and controls the temperature of the liquid 50 so that the flash boiling phenomenon appropriately occurs in the compression chamber 13.

Figure 7:
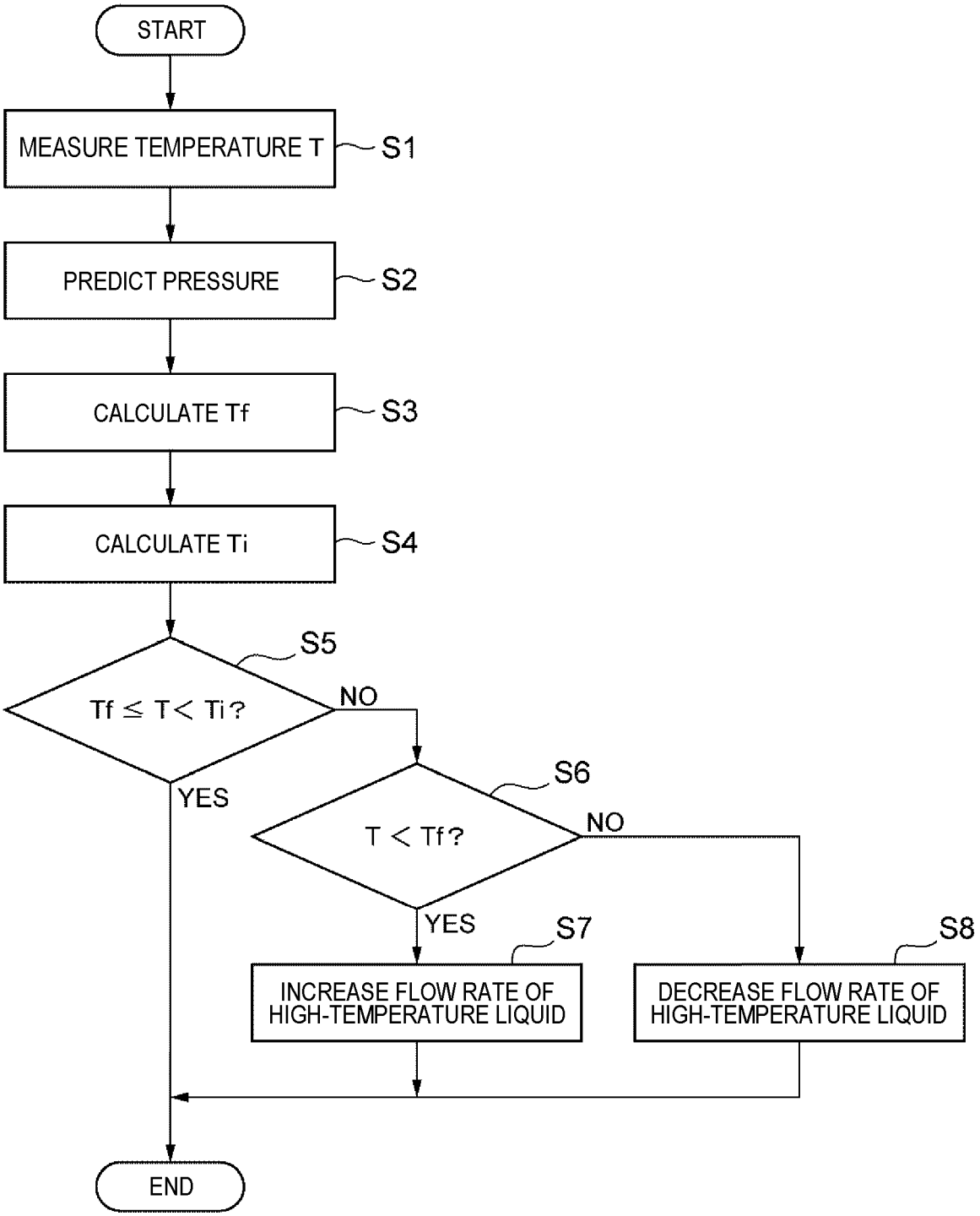
FIG. 7 is a flowchart related to temperature control of the liquid injected into the compressor.

FIG. 7 is a flowchart related to temperature control of the liquid 50 injected into the compressor 1.

In Step S1, the liquid feeding system 100 measures the temperature T of the injected liquid 50 by using the temperature measuring device 113.

In Step S2, the liquid feeding system 100 predicts the pressure inside the compressor 1 (compression chamber 13). As a method of predicting the pressure, a method of using the following Expression 1 on the assumption that the compression process of the gas is an adiabatic compression process can be considered.

$$p = p1\left(\frac{v1}{v}\right)^n \quad \text{[Math. 1]}$$

In Expression 1, p is the pressure of the compression chamber 13, p1 is the pressure of the gas sucked from the suction port 14, v is the volume of the compression chamber 13 at an injection position of the liquid 50, v1 is the volume of a first stage of the compression chamber 13, and n is a polytropic index. The polytropic index n may be adjusted between 1 and γ. γ is a specific heat ratio of the gas. Note that the liquid feeding system 100 may measure the pressure of the compression chamber 13 by using a pressure sensor instead of predicting the pressure of the compression chamber 13.

Furthermore, in Step S2, the liquid feeding system 100 predicts the injection pressure of the liquid 50. The liquid feeding system 100 can regard the discharge pressure of the pump 104 as the injection pressure of the liquid 50. The discharge pressure of the pump 104 can be calculated from the total lift of the pump 104 and the suction pressure. Note that the liquid feeding system 100 may measure the injection pressure of the liquid 50 by using a pressure sensor provided at a flow path (for example, the first flow path 109 or the third flow path 112) on the downstream side of the pump 104 instead of calculating the discharge pressure of the pump 104.

In Step S3, the liquid feeding system 100 calculates the saturation temperature Tf corresponding to the pressure of the compression chamber 13. The saturation temperature Tf may be calculated by interpolation calculation from a table set in advance, or may be calculated using an approximate expression as described below. When the liquid 50 is water, for example, the following Expression 2 is known as an approximate expression of the saturated vapor pressure.

$$E(t) = 6.1078 \times 10^{\frac{7.5t}{t+2373}} \quad \text{[Math. 2]}$$

In Expression 2, E(t) is the saturated vapor pressure (hPa), and t is the temperature (° C.). When Expression 2 is rearranged with respect to t, the following Expression 3 is obtained. When the liquid 50 is water, the saturation temperature Tf may be calculated using Expression 3.

$$t = \frac{237.5A}{7.5 - A},\ A = \log_{10}\frac{E(t)}{6.1078} \quad \text{[Math. 3]}$$

In Step S4, the liquid feeding system 100 calculates the saturation temperature Ti corresponding to the injection pressure of the liquid 50. Similarly to the saturation temperature Tf, the saturation temperature Ti may be calculated by interpolation calculation from a table set in advance, or may be calculated using approximate expressions as shown in the above Expressions 2 and 3. Then, the liquid feeding system 100 sets the target temperature range of the temperature T of the injected liquid 50 to Tf≤T<Ti.

In Step S5, the liquid feeding system 100 determines whether or not the temperature T of the liquid 50 measured in Step S1 falls within the target temperature range set in Step S4. That is, the liquid feeding system 100 determines whether or not Tf≤T<Ti is satisfied. When Tf≤T<Ti is satisfied, the liquid feeding system 100 ends the temperature control of the liquid 50 illustrated in FIG. 7. When Tf≤T<Ti is not satisfied, the liquid feeding system 100 proceeds to Step S6.

In Step S6, the liquid feeding system 100 determines whether or not the temperature T of the liquid 50 measured in Step S1 is lower than the saturation temperature Tf set in Step S4. That is, the liquid feeding system 100 determines whether or not T<Tf is satisfied. When T<Tf is satisfied, the liquid feeding system 100 proceeds to Step S7 to increase the temperature T of the injected liquid 50. When T<Tf is not satisfied, the liquid feeding system 100 proceeds to Step S8 to lower the temperature T of the injected liquid 50.

In Step S7, the liquid feeding system 100 adjusts the flow rate adjusting valve 114 to increase the flow rate of the high-temperature liquid 50 flowing through the second flow path 110. As a result, the temperature T of the injected liquid 50 increases. Thereafter, the liquid feeding system 100 ends the temperature control of the liquid 50 illustrated in FIG. 7.

In Step S8, the liquid feeding system 100 adjusts the flow rate adjusting valve 114 to reduce the flow rate of the high-temperature liquid 50 flowing through the second flow path 110. As a result, the temperature T of the injected liquid 50 is lowered. Thereafter, the liquid feeding system 100 ends the temperature control of the liquid 50 illustrated in FIG. 7.

By performing the temperature control of the liquid 50 illustrated in FIG. 7 at regular time intervals, the liquid feeding system 100 can keep the temperature T of the injected liquid 50 within the target temperature range $Tf \leq T < Ti$ in which the flash boiling phenomenon can be appropriately caused in the compression chamber 13.

As described above, the liquid feeding system 100 in Embodiment 1 is a liquid feeding system that injects the liquid 50 into the compressor 1 that compresses the gas (compression chamber 13). The liquid feeding system 100 adjusts the temperature of the liquid 50 injected into the compressor 1 to a temperature equal to or higher than the saturation temperature Tf corresponding to the pressure of the compression chamber 13, and injects the liquid 50 into the compressor 1.

As a result, the liquid feeding system 100 in Embodiment 1 can cause a flash boiling phenomenon of the liquid 50 inside the compressor 1 (compression chamber 13). The liquid feeding system 100 can evaporate the liquid 50 by forming fine droplets in a short time without generating a swirling flow of the liquid 50 or causing the liquids injected from the two jetting nozzles to collide with each other. Thus, according to Embodiment 1, it is possible to provide the liquid feeding system 100 of the compressor 1, which is capable of easily realizing fine droplets of the liquid 50 injected into the compressor 1.

Further, the liquid feeding system 100 in Embodiment 1 adjusts the temperature of the liquid 50 injected into the compressor 1 to a temperature lower than the saturation temperature Ti corresponding to the pressure of the liquid 50 at the time of injection into the compression chamber 13, and injects the liquid 50 into the compressor 1.

As a result, the liquid feeding system 100 in Embodiment 1 can suppress an occurrence of a situation in which the liquid 50 starts to boil before being injected into the compressor 1. The liquid feeding system 100 can appropriately cause the flash boiling phenomenon of the liquid 50 inside the compressor 1. Thus, according to Embodiment 1, it is possible to provide the liquid feeding system 100 of the compressor 1, which is capable of easily and appropriately realizing fine droplets of the liquid 50 injected into the compressor 1.

Further, the liquid feeding system 100 in Embodiment 1 includes the pump 104 that pressurizes the liquid 50, the first flow path 109 through which the liquid 50 pressurized by the pump 104 flows, and the second flow path 110 through which the liquid 50 that is discharged from the compressor 1 and has a higher temperature than the liquid 50 flowing through the first flow path 109 flows. The liquid feeding system 100 includes the mixer 111 that mixes the liquid 50 flowing through the first flow path 109 and the liquid 50 flowing through the second flow path 110, and the third flow path 112 that injects the liquid 50 mixed by the mixer 111 into the compressor 1. The liquid feeding system 100 includes the flow rate adjusting valve 114 that adjusts the temperature of the liquid 50 flowing through the third flow path 112 by adjusting the flow rate of the liquid 50 flowing through the first flow path 109 or the second flow path 110.

As a result, the liquid feeding system 100 in Embodiment 1 can adjust the temperature of the liquid 50 injected into the compressor 1 to cause the flash boiling phenomenon in a narrow space such as the inside of the compressor 1 even with a relatively simple configuration. In addition, since the liquid feeding system 100 can adjust the temperature of the liquid 50 injected to the compressor 1 by using the high-temperature liquid 50 discharged from the compressor 1, a special heating unit is not required, and a simple flow path configuration can be achieved. Thus, according to Embodiment 1, it is possible to provide the liquid feeding system 100 of the compressor 1, which is capable of further easily realizing fine droplets of the liquid 50 injected into the compressor 1.

Further, in the liquid feeding system 100 in Embodiment 1, the flow rate adjusting valve 114 adjusts the flow rate of the liquid 50 so that the temperature of the liquid 50 flowing through the third flow path 112 is equal to or higher than the saturation temperature Tf corresponding to the pressure inside the compressor 1.

As a result, the liquid feeding system 100 in Embodiment 1 can cause the flash boiling phenomenon in a narrow space such as the inside of the compressor 1 and evaporate the liquid 50 by forming fine droplets in a short time with a relatively simple configuration. Thus, according to Embodiment 1, it is possible to provide the liquid feeding system 100 of the compressor 1, which is capable of easily and reliably realizing fine droplets of the liquid 50 injected into the compressor 1.

Further, in the liquid feeding system 100 in Embodiment 1, the flow rate adjusting valve 114 adjusts the flow rate of the liquid 50 so that the temperature of the liquid 50 flowing through the third flow path 112 is lower than the saturation temperature Ti corresponding to the pressure (injection pressure) of the liquid 50 at the time of being injected into the compressor 1.

As a result, the liquid feeding system 100 in Embodiment 1 can suppress an occurrence of a situation in which the liquid 50 starts to boil before being injected into the compressor 1 and the third flow path 112 is filled with the vapor of the liquid 50. The liquid feeding system 100 can inject a sufficient amount of the liquid 50 into the compressor 1, and can appropriately cause a flash boiling phenomenon of the liquid 50 in the compressor 1. Thus, according to Embodiment 1, it is possible to provide the liquid feeding system 100 of the compressor 1, which is capable of easily and appropriately realizing fine droplets of the liquid 50 injected into the compressor 1.

Further, in the liquid feeding system 100 in Embodiment 1, the liquid 50 (for example, water) injected into the compressor 1 is a substance of the same type (component) as the gas (for example, water vapor) compressed by the compressor 1.

That is, in the liquid feeding system 100, when the liquid 50 injected into the compressor 1 evaporates in the compressor 1, it is possible to improve the density (vapor density) of the compressed gas because the liquid 50 becomes the same substance as the compressed gas of the compressor 1. As a result, in the liquid feeding system 100, even when the suction pressure of the compressor 1 is low, by evaporating the liquid 50 injected into the compressor 1 inside the compressor 1, it is possible to improve the discharge pressure of the compressor 1 and to suppress a decrease in the output of the compressor 1. Thus, according to Embodiment 1, it is possible not only to easily realize fine droplets of the liquid 50 injected into the compressor 1, but also to increase the output and stabilize the output of the compressor 1 with a simple configuration.

Note that the flowchart illustrated in FIG. 7 is an example of the temperature control of the injected liquid 50, and the order of steps may be changed as necessary. In addition, it is not necessary to perform all the steps illustrated in FIG. 7 during the operation of the compressor 1. For example, when the flow rate of the liquid 50 supplied to the gas-liquid separator 106 is small and the flow rate of the liquid 50 flowing through the second flow path 110 is small, the flow rate adjusting valve 114 may be closed until the flow rate of the liquid 50 flowing through the second flow path 110 sufficiently increases, and only the liquid 50 flowing through the first flow path 109 may be supplied to the mixer 111.

Embodiment 2

A liquid feeding system 100 according to Embodiment 2 will be described with reference to FIG. 8. In the liquid feeding system 100 in Embodiment 2, the description of the similar configuration and operation as those in Embodiment 1 will be omitted.

Figure 8:
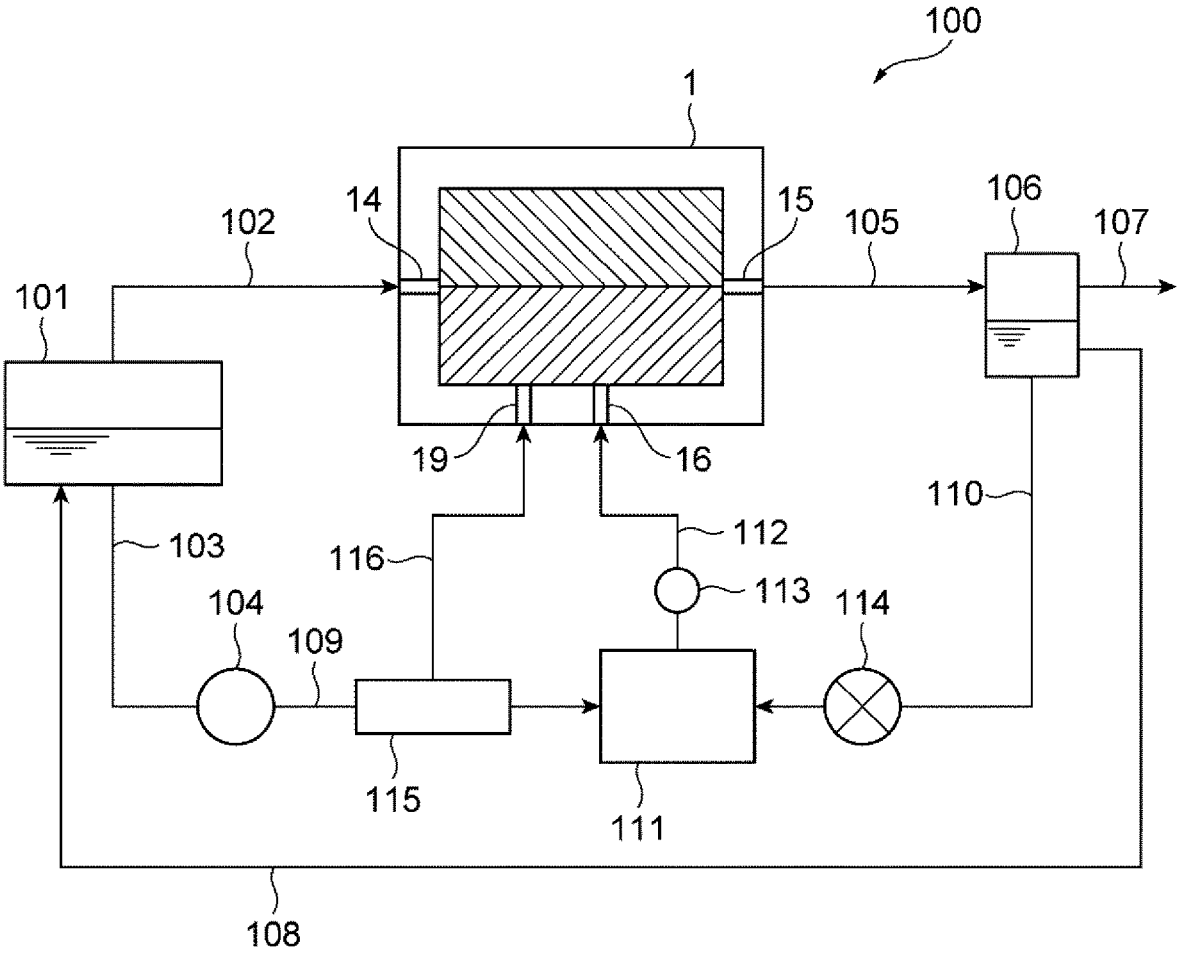
FIG. 8 diagram illustrating a configuration of a liquid feeding system in Embodiment 2.

FIG. 8 is a diagram illustrating a configuration of the liquid feeding system 100 in Embodiment 2. FIG. 8 is a diagram corresponding to FIG. 3.

The liquid feeding system 100 in Embodiment 2 is obtained by adding a distributor 115 and a fourth flow path 116 to the liquid feeding system 100 in Embodiment 1. The distributor 115 is provided on the first flow path 109. The distributor 115 splits the liquid 50 flowing through the first flow path 109 into a liquid 50 flowing toward the mixer 111 and a liquid 50 flowing toward the compressor 1. The fourth flow path 116 is a pipe that causes the distributor 115 to communicate with a liquid feeding hole 19 of the compressor 1. The fourth flow path 116 supplies the liquid 50 split by the distributor 115 into the compressor 1. That is, the fourth flow path 116 is a flow path for supplying the liquid 50 flowing through the first flow path 109 into the compressor 1 while bypassing the mixer 111.

As a result, the liquid feeding system 100 in Embodiment 2 can supply the liquid 50 for sealing the gap between the male rotor 3 and the female rotor 4 and the gap between the male rotor 3 or the female rotor 4, and the casing 5 into the compressor 1 through a flow path different from the flow path of the liquid 50 for cooling the compressed gas. Thus, the liquid feeding system 100 in Embodiment 2 can easily secure the amount of the liquid 50 required for sealing these gaps as compared with Embodiment 1. Therefore, the liquid feeding system 100 in Embodiment 2 not only can easily realize fine droplets of the liquid 50 injected into the compressor 1, but also can stabilize the output of the compressor 1 with a simple configuration.

Embodiment 3

A liquid feeding system 100 according to Embodiment 3 will be described with reference to FIG. 9. In the liquid feeding system 100 in Embodiment 3, the description of the similar configuration and operation as those in Embodiment 1 will be omitted.

Figure 9:
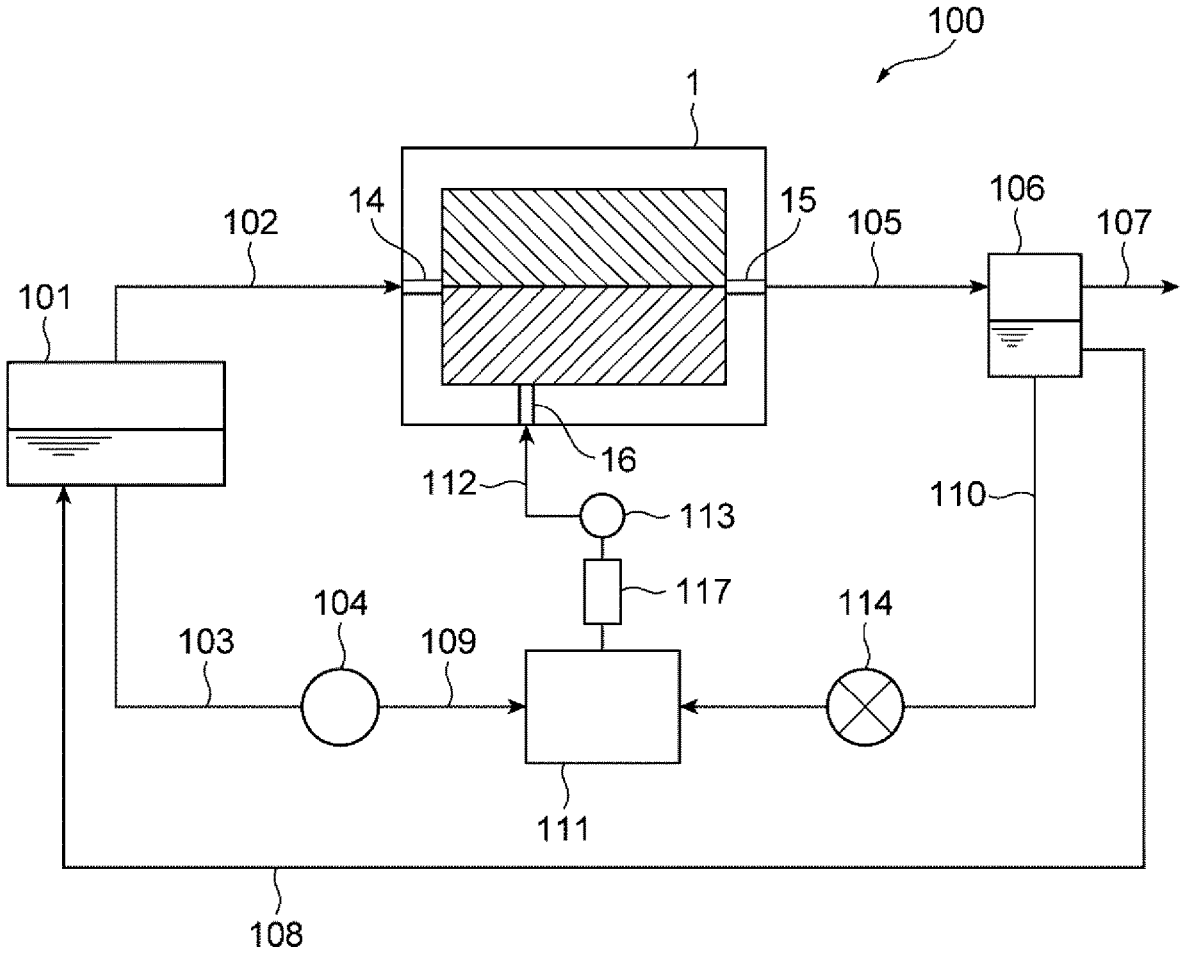
FIG. 9 is a diagram illustrating a configuration of a liquid feeding system in Embodiment 3.

FIG. 9 is a diagram illustrating a configuration of the liquid feeding system 100 in Embodiment 3. FIG. 9 is a diagram corresponding to FIG. 3.

The liquid feeding system 100 in Embodiment 3 is obtained by adding a heater 117 to the liquid feeding system 100 in Embodiment 1. The heater 117 is provided on the third flow path 112 between the mixer 111 and the temperature measuring device 113. The heater 117 heats the liquid 50 flowing through the third flow path 112. At this time, the heater 117 heats the liquid 50 so that the temperature of the liquid 50 flowing through the third flow path 112 is equal to or higher than the saturation temperature Tf corresponding to the pressure inside the compressor 1.

As a result, the liquid feeding system 100 in Embodiment 3 can raise the temperature of the liquid 50 flowing through the third flow path 112 to the saturation temperature Tf or higher even when the amount of the high-temperature liquid 50 stored in the liquid chamber of the gas-liquid separator 106 is insufficient and the temperature of the liquid 50 flowing through the third flow path 112 does not increase even if the flow rate adjusting valve 114 is fully opened. Thus, the liquid feeding system 100 in Embodiment 3 can reliably cause the flash boiling phenomenon of the liquid 50 inside the compressor 1 even at the initial stage of the operation of the compressor 1. Therefore, according to Embodiment 3, it is possible to easily and reliably realize fine droplets of the liquid 50 injected into the compressor 1.

Note that when an electric heating type heater or the like is used as the heater 117, the energy consumption amount increases as a whole of the compressor 1 and the liquid feeding system 100. It is preferable that the heater 117 can heat the liquid 50 by using the exhaust heat of an external heat source, because the energy consumption amount of the compressor 1 and the liquid feeding system 100 can be suppressed as a whole.

Others

The present invention is not limited to the above embodiments, and various modification examples may be provided. For example, the above embodiments have been described in detail in order to explain the present invention in an easy-to-understand manner, and the above embodiments are not necessarily limited to a case including all the described configurations. Further, some components in one embodiment can be replaced with the components in another embodiment, and the configuration of another embodiment can be added to the configuration of one embodiment. Regarding some components in the embodiment, other components can be added, deleted, and replaced.

Some or all of the configurations, functions, processing units, processing means, and the like may be realized by hardware by being designed with an integrated circuit, for example. Further, the above-described respective components, functions, and the like may be realized by software by the processor interpreting and executing a program for realizing the respective functions. Information such as a program, a tape, and a file, that realizes each function can be stored in a memory, a recording device such as a hard disk and a solid state drive (SSD), or a recording medium such as an IC card, an SD card, and a DVD.

Control lines and information lines considered necessary for the descriptions are illustrated, and not all the control lines and the information lines in the product are necessarily shown. In practice, it may be considered that almost all components are connected to each other.

REFERENCE SIGNS LIST

1 compressor
50 liquid
100 liquid feeding system
104 pump
109 first flow path
110 second flow path
111 mixer
112 third flow path
113 temperature measuring device
114 flow rate adjusting valve
115 distributor
116 fourth flow path
117 heater

The invention claimed is:

1. A liquid feeding system for injecting liquid into a compressor that compresses a gas, the liquid feeding system including:

a pump configured to pressurize a pressure of the liquid;

a first flow path through which the liquid pressurized by the pump flows;

a second flow path through which the liquid discharged from the compressor flows, the liquid having a temperature higher than a temperature of the liquid flowing through the first flow path;

a mixer configured to mix the liquid flowing through the first flow path with the liquid flowing through the second flow path;

a third flow path configured to inject the liquid mixed by the mixer into the compressor; and a flow rate adjusting valve configured to adjust a temperature of the liquid flowing through the third flow path by adjusting a flow rate of the liquid flowing through the first flow path or the second flow path, wherein a temperature of the liquid injected into the compressor is adjusted to a temperature equal to or higher than a saturation temperature corresponding to a pressure inside the compressor, and the liquid is injected into the compressor.

2. The liquid feeding system according to claim 1, wherein the temperature of the liquid injected into the compressor is adjusted to a temperature lower than the saturation temperature corresponding to the pressure of the liquid at the time of injection into the compressor, and the liquid is injected into the compressor.

3. The liquid feeding system according to claim 1, wherein the flow rate adjusting valve adjusts the flow rate so that the temperature of the liquid flowing through the third flow path is equal to or higher than the saturation temperature corresponding to the pressure inside the compressor.

4. The liquid feeding system according to claim 3, wherein the flow rate adjusting valve adjusts the flow rate so that the temperature of the liquid flowing through the third flow path is lower than a saturation temperature corresponding to a pressure of the liquid at the time of injection into the compressor.

5. The liquid feeding system according to claim 1, wherein the liquid injected into the compressor is a substance of the same type as the gas compressed by the compressor.

6. The liquid feeding system according to claim 1, further comprising:

a fourth flow path configured to supply the liquid flowing through the first flow path to the compressor while bypassing the mixer.

7. The liquid feeding system according to claim 1, further comprising:

a heater configured to heat the liquid flowing through the third flow path, wherein the heater heats the liquid so that the temperature of the liquid flowing through the third flow path is equal to or higher than the saturation temperature corresponding to the pressure inside the compressor.

* * * * *